US007802892B2

(12) United States Patent
Young

(10) Patent No.: US 7,802,892 B2
(45) Date of Patent: Sep. 28, 2010

(54) DECORATABLE LIGHT BOX

(76) Inventor: Ava Young, 7764 N. Paseo Monerrat, Tucson, AZ (US) 85704

( * ) Notice: Subject to any disclaimer, the term of this patent is extended or adjusted under 35 U.S.C. 154(b) by 169 days.

(21) Appl. No.: 11/857,381

(22) Filed: Sep. 18, 2007

(65) Prior Publication Data

US 2009/0073673 A1 Mar. 19, 2009

(51) Int. Cl.
*G09F 13/00* (2006.01)

(52) U.S. Cl. ..... 362/97.1; 362/253; 362/311.13; 362/351

(58) Field of Classification Search ..... 362/296.01, 362/97.1, 362, 253, 565, 234, 249.16, 311.01, 362/311.13, 311.14, 351, 806–808, 811; 434/365

See application file for complete search history.

(56) References Cited

U.S. PATENT DOCUMENTS 5,207,495 A * 5/1993 Ahlstone ..... 362/33
5,270,910 A * 12/1993 Kile ..... 362/216

OTHER PUBLICATIONS

Ava Young (inventor) has sold a light box product prior to Sep. 18, 2006 which is significantly different than currently claimed product.

* cited by examiner

*Primary Examiner*—Bao Q Truong

(57) ABSTRACT

This invention relates to an artistic light box having a light-transparent display panel, the entire display panel being covered by a single sheet; a side panel attaching to and extending outwardly from the display panel; and an illumination source positioned at the back surface of the display panel. The light box may be used as a night-light, an illuminated piece of art, an illuminated craft product, or an illuminated learning tool. The light box may also be personalized by a user.

1 Claim, 5 Drawing Sheets

DECORATABLE LIGHT BOX

FIELD OF THE INVENTION

The present invention features a light box that can be decorated, which may be used as a night-light, an illuminated craft product, an illuminated learning tool, or as a piece of illuminated art. The light box may be personalized by a user.

BACKGROUND OF THE INVENTION

This invention relates to a light box, which can be used as a piece of illuminated art, or it can also be used as a night-light, an illuminated craft product, or an illuminated learning tool.

Night-lights or light boxes used as art usually cannot be reused or personalized. The coverings or decorations on the night-light or light box are typically attached to the light box permanently. This prevents a user from modifying the light box and personalizing it, which limits a user's ability to display artistic expression. A light box that can be reused and personalized encourages a user's creativity and imagination. Also, a night-light that is personalized has the advantage of making a child's room feel more warm and comforting. Therefore, there is a need for an improved light box, where the light box can be reused and personalized by the user.

This invention provides an artistic light box, which can be used as illuminated art or as a night-light, and provides a means of reusing and personalizing the light box over and over again according to the user's preference. The current invention is designed such that the coverings and decorations on the light box are not permanently attached, but can be easily removed and replaced with other coverings or decorations.

SUMMARY OF THE INVENTION

The present invention provides an artistic light box, which may be used as a night-light, a piece of illuminated art, an illuminated craft product, or an illuminated learning tool. The light box comprises a light-transparent display panel, a side panel attaching to and extending outwardly from the display panel, and an illumination source positioned at the back surface of the display panel. The entire surface of the display panel is covered by one or more single sheets, which sometimes comprise ethereal paper or rice paper. The invention also describes a kit comprising said light box and a plurality of decorative members, which are for decorating the light box according to the user's preference. Furthermore, the invention also teaches a method of reusing and personalizing the light box by removing the single sheets and decorative members covering the display panel and replacing them with other single sheets and decorative members.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1A:
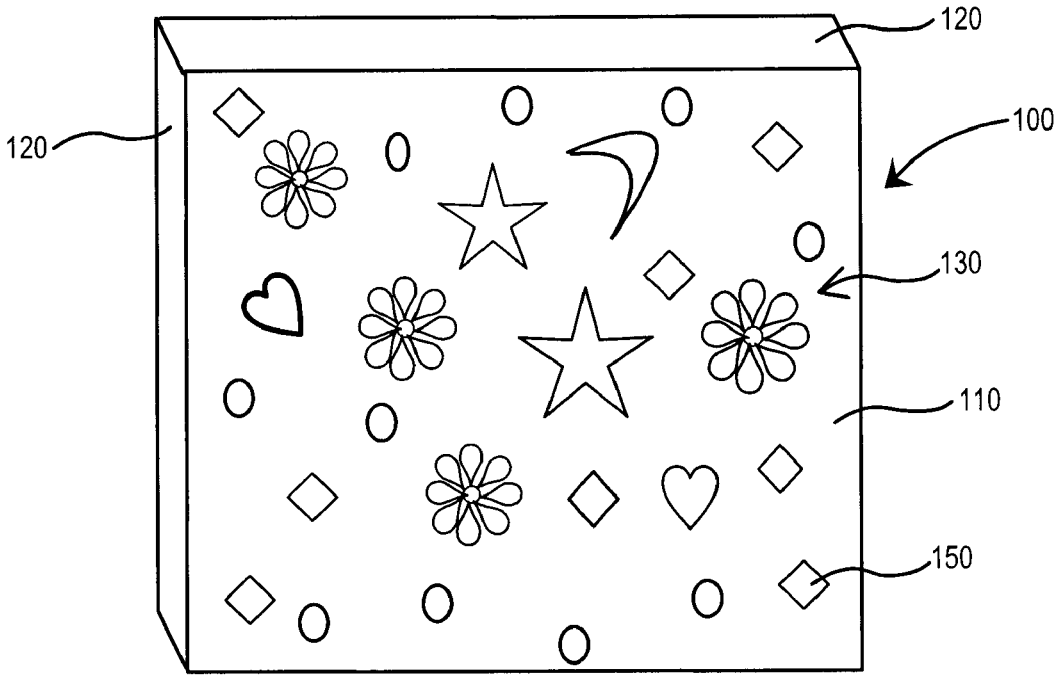
FIG. 1A is a perspective view of one embodiment of the present light box invention.
Figure 1B:
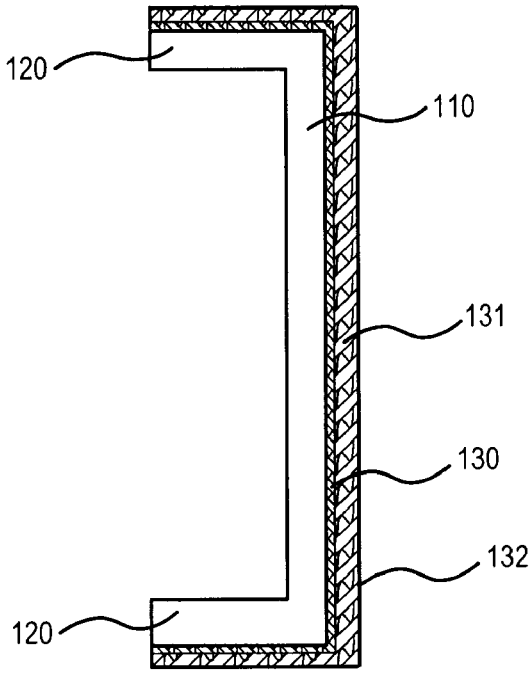
FIG. 1B is a cross-sectional view of the light box of FIG. 1A, illustrating how a first single sheet, a second single sheet, and a third single sheet covers the display panel and side panels.
Figure 2:
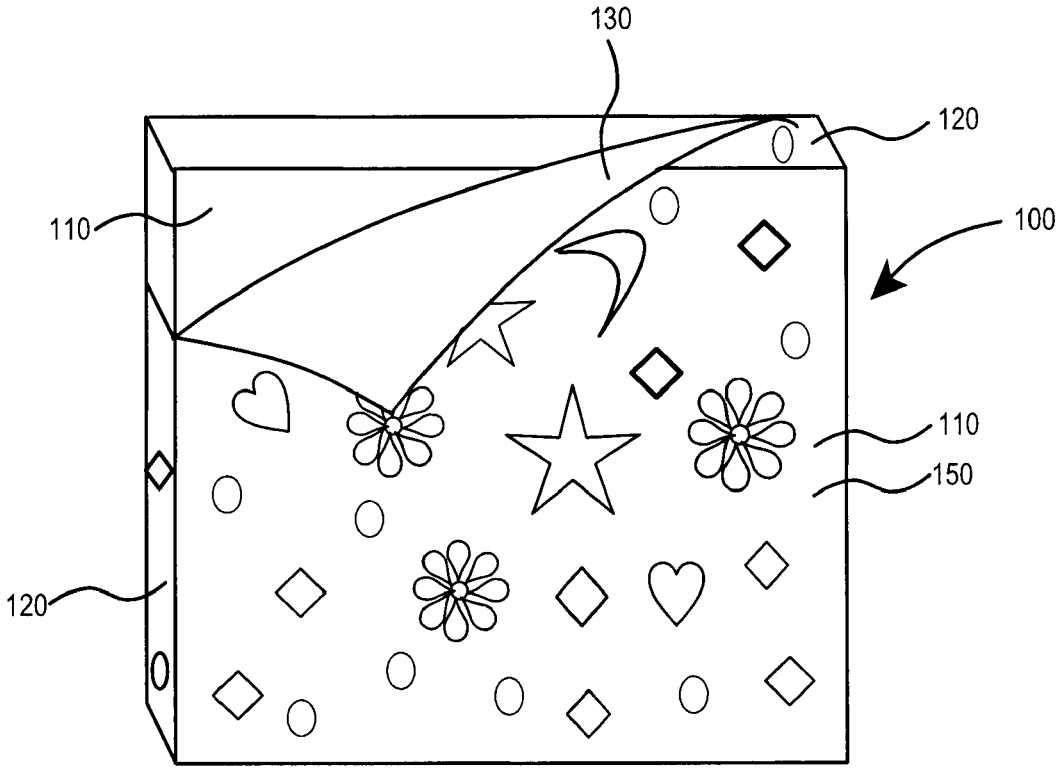
FIG. 2 is a perspective view of the light box of FIG. 1A, illustrating how the single sheets that cover the display panel and the side panels can be removed.

The following is a listing of numbers corresponding to a particular element refer to herein:

100 light box
110 display panel
115 back surface of display panel
120 side panel
125 inside face of side panel
130 first single sheet
131 second single sheet
132 third single sheet
140 wall hook
141 ventilation hole
142 power cord hole
150 decorative member
200 lighting system
210 power cord
220 illumination source
230 adhesive-backed mounting base
235 plastic tie The present invention features an artistic light box, which may be used as a night-light, a piece of illuminated art, an illuminated craft product, or an illuminated learning tool. A user can personalize the light box, for example, for educational purposes, for artistic development purposes, or for enjoyment.

For any embodiment of the present invention, the term "transparent" is interchangeable with the term translucent, semi-translucent, semi-transparent, or semi-opaque. For example, an embodiment of a light box that comprises a light-transparent display panel may be constructed using a light-translucent display panel.

As illustrated in FIGS. 1 through 5, in some embodiments, the light box 100 consists of a display panel 110 in the shape of a rectangle, and four side panels 120. In some embodiments, the display panel 110 and the side panels 120 may be constructed from a rigid plastic, for example, an acrylic (also known as polymethyl methacrylate). In some embodiments, examples of acrylic materials that may be used in accordance with the present invention may be obtained commercially under the name Plexiglas®, Limacryl®, R-Cast®, Perspex®, Plazcryl®, Acrylex®, Acrylite®, Acrylplast®, Altuglas®, Polycast®, Lucite®, or acrylic glass. In some embodiments, the inside faces of the side panels 125 are covered with a reflective material. In some embodiments, the side panels 120 are attached to and extend outwardly from the edges of the display panel 110, creating a box-like structure. In some embodiments, the side panels 120 comprise a ventilation hole 141 and a power cord hole 142.

In the embodiment illustrated in FIGS. 1 through 5, the front surface of the display panel 110 and the side panels 120 are entirely covered by a first single sheet 130. In some embodiments, only the front surface of the display panel 110 is entirely covered by a first single sheet 130. In some embodiments, the first single sheet 130 is entirely covered by a second single sheet 131, and the second single sheet 131 is entirely covered by a third single sheet 132. In some embodiments, the first single sheet 130 and second single sheet 131 comprise ethereal paper. In some embodiments, the third single sheet 132 is a piece of rice paper. Without wishing to limit the invention to any theory or mechanism, it is believed that in some embodiments, it would be advantageous to use ethereal paper because it is inexpensive, thin, strong, smooth, easy to work with, it does not show fingerprints after being touched when damp, and the fibers of the paper can be seen, adding to aesthetic appeal. In some embodiments, it would be advantageous to use rice paper because it is thin, strong, smooth, easy to work with, and has gold and silver flecks, which adds to the aesthetic appeal of the light box and gives the display panel a shiny look.

In some embodiments, the first single sheet 130, the second single sheet 131, and the third single sheet 132 are attached to the display panel 110 and side panels 120 with a gluing solution. In some embodiments, the gluing solution is a mixture of about 50% tacky glue and about 50% water. In some embodiments, it would be advantageous to use a gluing solution comprising 50% tacky glue and 50% water because it is inexpensive, thin and free of clumps, water based and thus easy to dissolve in water, easy to use, does not have a strong odor, does not create watermarks when applied to the ethereal paper or rice paper, and does not permanently glue the single sheets to the display panel 110. Because the single sheets are not permanently glued to the display panel 110, a user can personalize or recycle the display panel 110 by removing the single sheets and applying one or more other single sheets to the display panel 110. In order to remove the single sheets from the display panel 110, in some embodiments the sheets are dampened with water and peeled away from the display panel 110.

Figure 3:
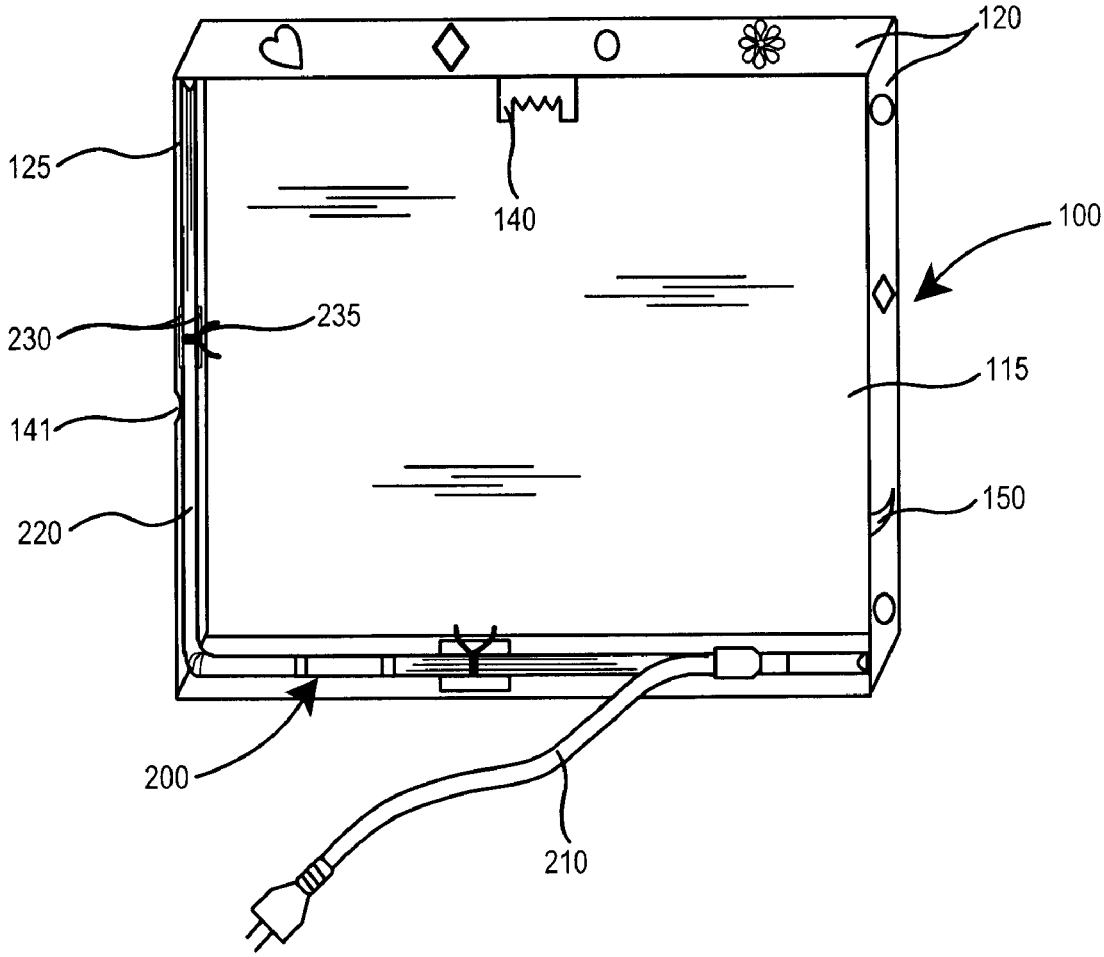
FIG. 3 is a back view of the light box of FIG. 1.
Figure 4:
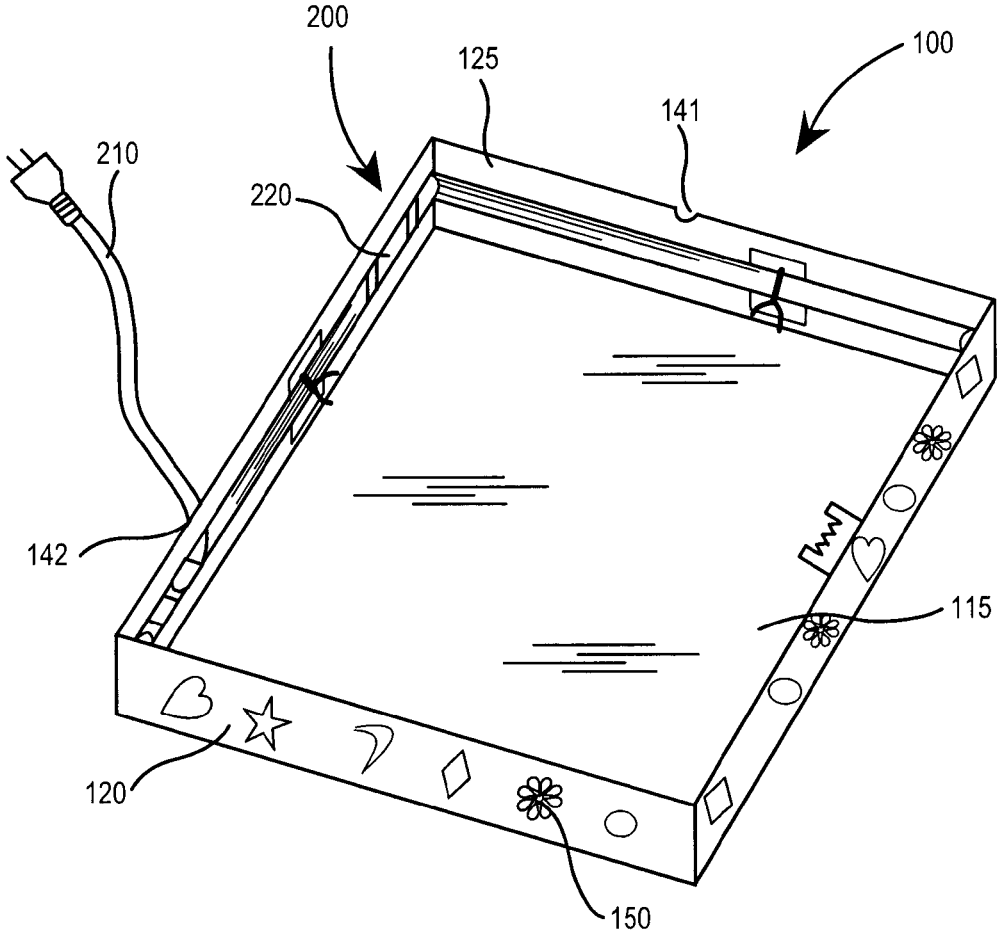
FIG. 4 is a side view of the light box of FIG. 1.
Figure 5:
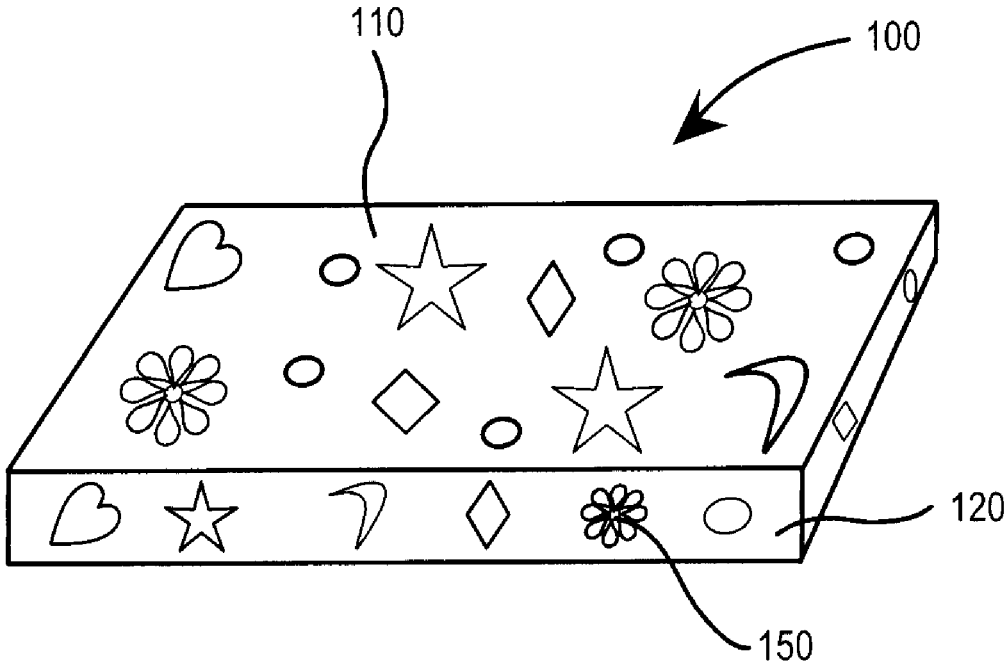
FIG. 5 is another side view of the light box of FIG. 1.

Again referring to FIGS. 1 though 5, the light box 100 is illuminated by lighting system 200. In some embodiments, the lighting system 200 comprises an illumination source 220 connected to a power cord 210 for plugging into a wall outlet. In some embodiments, the illumination source 220 comprises a 120-volt rope light. In some embodiments, the rope light illumination source 220 of lines an inside perimeter of the light box and is attached to the inside face of the four side panels 125 by four adhesive mounting bases 230 and four plastic ties 235. As illustrated in FIG. 3, in some embodiments, the light box 100 further comprises a saw-toothed hook 140 for mounting on a wall.

Although the display panel 110 of the embodiment described above is in the shape of a rectangle, in some embodiments the display panel 110 is in the shape of a square, a circle, an oval, a semicircle, a trapezoid, a parallelogram, a rhombus, a triangle, a star, a pentagon, a hexagon, a heptagon, or an octagon. In some embodiments, the display panel 110 is in the shape of a square, the dimensions of the square display panel 110 being in the range of about three (3) inches by three (3) inches to forty (40) inches by forty (40) inches. In some embodiments, the side panels are in the range of about one (1) to eight (8) inches wide and three (3) inches to forty (40) inches tall. In some embodiments, the display panel 110 is in the shape of a circle, the diameter of the circle being in the range of about three (3) inches to forty (40) inches. In some embodiments, the display panel 110 is in the shape of a triangle, the dimensions of the sides being in the range of about three (3) inches to forty (40) inches. In some embodiments, the display panel 110 is in the shape of a rectangle, the sides having the dimensions of ten (10) inches by eight (8) inches.

In some embodiments, the display panel 110 is light-transparent, light-translucent, semi-transparent, semi-translucent, semi-opaque, or combinations thereof. In some embodiments, the display panel 110 has color such as red, yellow, green, blue, orange, purple, black, brown, white, or combinations thereof.

Although the display panel 110 in the embodiment described above comprises acrylic, in some embodiments, the display panel 110 comprises polystyrene (PS), polypropylene (PP), low density polyethylene (LDPE), polyvinylchloride (PVC), high density polyethylene (HDPE), polyethylene terephthalate (PET), glass, derivatives thereof, or combinations thereof. In some embodiments, the side panel 120 comprises an acrylic mirror. In some embodiments, the acrylic mirror has color such as red, yellow, green, blue, orange, purple, black, brown, white, or combinations thereof.

In some embodiments, the display panel 110 is covered with only a first single sheet 130. In some embodiments, the display panel 110 is covered with a first single sheet 130, and the first single sheet 130 is covered with a second single sheet 131. In some embodiments, the display panel 110 is covered with a first single sheet 130, a second single sheet 131, and a third single sheet 132. In some embodiments, the display panel 110 is covered with single sheets comprising one or more of the following: ethereal paper, rice paper, tissue paper, mulberry paper, or fabric, banana paper, lokta paper, Florentine paper, washi paper, chiyogami paper, Thai paper, bamboo leaf, unryu paper, Thai lace, embossed paper, handmade paper, screen-printed paper, marbled paper, silk paper, ayanishiki paper, momi paper, pictograph paper, fabric, or combinations thereof. In some embodiments, the display panel 110 can be made shiny with stardust, glitter, glitter glue, gold leafing, gold and silver flecks, or combinations thereof. In some embodiments, the single sheet comprises a paper having a strength equal to or greater than the strength of tissue paper. Without wishing to limit the invention to any theory or mechanism, it is believed that in some embodiments, it would be advantageous to use tissue paper because it is thin, translucent, inexpensive, it would be smooth when it is applied to the display panel 110, and it is available in many colors. In some embodiments, it would be advantageous to use Thai paper because it is thin, inexpensive, translucent, has an aesthetically pleasing appearance, it would be smooth when it is applied to the display panel 110, it is easy to work with, and it is available in many colors and varieties. In some embodiments, it would be advantageous to use embossed paper because it is thin, inexpensive, translucent, and available in many varieties. In some embodiments, it would be advantageous to use unryu paper because it is translucent, it would be smooth when it is applied to the display panel 110, and it is available in many colors.

In some embodiments, the light box 100 is constructed so that the display panel 110 reduces 5% of the light transmitting through it. In some embodiments, the light box 100 is constructed so that the display panel 110 reduces 10% of the light transmitting through it. In some embodiments, the light box 100 is constructed so that the display panel 110 reduces 25% of the light transmitting through it. In some embodiments, the light box 100 is constructed so that the display panel 110 reduces 50% of the light transmitting through it. In some embodiments, the light box 100 is constructed so that the display panel 110 reduces 75% of the light transmitting through it. In some embodiments, the light box 100 is constructed so that the display panel 110 reduces 90% of the light transmitting through it. In some embodiments, the light box 100 is constructed so that the display panel 110 reduces 95% of the light transmitting through it.

In some embodiments, the light box 100 has points of light rather than even lighting. For example, in some embodiments, the illumination source 220 comprises a light bulb, which produces a point of light on the display panel 110 rather than illuminating the display panel 110 evenly.

In some embodiments, the gluing solution comprises about 10-90% water and a glue. In some embodiments, the gluing solution comprises about 10-80% water and a glue. In some embodiments, the gluing solution comprises about 10-70% water and a glue. In some embodiments, the gluing solution comprises about 10-60% water and a glue. In some embodiments, the gluing solution comprises about 10-50% water and a glue. In some embodiments, the gluing solution comprises about 10-40% water and a glue. In some embodiments, the gluing solution comprises about 10-30% water and a glue. In some embodiments, the gluing solution comprises about 10-20% water and a glue. In some embodiments, the gluing solution comprises a tacky glue, a glitter glue, a white glue, a yellow glue, a fabric glue, a wallpaper paste, a polyurethane glue, a water-based glue, a gloss-based sealer, a surfactant, derivatives thereof, or combinations thereof.

In some embodiments, the gluing solution comprises about 10-90% glue and water. In some embodiments, the gluing solution comprises about 10-80% glue and water. In some embodiments, the gluing solution comprises about 10-70% glue and water. In some embodiments, the gluing solution comprises about 10-60% glue and water. In some embodiments, the gluing solution comprises about 10-50% glue and water. In some embodiments, the gluing solution comprises about 10-40% glue and water. In some embodiments, the gluing solution comprises about 10-30% glue and water. In some embodiments, the gluing solution comprises about 10-20% glue and water.

In some embodiments, the gluing solution comprises about 10% water and 90% glue. In some embodiments, the gluing solution comprises about 20% water and 80% glue. In some embodiments, the gluing solution comprises about 30% water and 70% glue. In some embodiments, the gluing solution comprises about 40% water and 60% glue. In some embodiments, the gluing solution comprises about 50% water and 50% glue. In some embodiments, the gluing solution comprises about 60% water and 40% glue. In some embodiments, the gluing solution comprises about 70% water and 30% glue. In some embodiments, the gluing solution comprises about 80% water and 20% glue. In some embodiments, the gluing solution comprises about 90% water and 10% glue. In some embodiments, the gluing solution comprises about 100% glue. In some embodiments, the gluing solution comprises a tacky glue, a glitter glue, a white glue, a yellow glue, a fabric glue, a wallpaper paste, a polyurethane glue, a water-based glue, a gloss-based sealer, a surfactant, derivatives thereof, or combinations thereof.

In some embodiments, the light box 100 may be decorated with a decorative member 150. In some embodiments, the decorative member 150 includes but is not limited to a bead, a silk flower, a dried flower, a magnet, a piece of glass, a stone, a piece of foam, a photograph, a transparency, a piece of string, a piece of yarn, a piece of ribbon, a piece of wrapping paper, a piece of metal, a piece of fabric, a piece of plastic, a gold leaf, a fabric leaf, a semi-precious stone, a gold foil, a silver foil, a copper foil, an ink stamp, a paper stamp, a marker ink, a paint, a glass paint, an acrylic paint, a gel, a wire, a sticker, a crayon drawing, raffia, a mechanical decorative member, or combinations thereof. In some embodiments, a user attaches decorative members 150 to the light box 100 according to his or her preference. In some embodiments, the decorative members 150 may be attached to the display panel 110, the first single sheet 130, the second single sheet 131, the third single sheet 132, the side panels 120, the back surface of the display panel 115, the inside face of the side panels 125, or a combination thereof. In some embodiments, a mechanical decorative member is attached to the display panel 110, the first single sheet 130, the second single sheet 131, the third single sheet 132, the side panels 120, the back surface of the display panel 115, the inside face of the side panels 125, or a combination thereof.

In some embodiments, the illumination source 220 comprises one or more light bulbs, a black light, a strobe light, a light-emitting diode (LED) light, or string lights. In some embodiments the illumination source 220 comprises an incandescent light, a fluorescent light, or a halogen light. In some embodiments, the illumination source 220 is battery operated. In some embodiments, the illumination source 220 has an on/off switch.

In some embodiments, the light box 100 is provided as a part of a kit. The kit comprises the light box 100 and a plurality of decorative members 150, which are for a user to attach to the light box 100. In some embodiments, decorative members 150 include but are not limited to a bead, a silk flower, a dried flower, a magnet, a piece of glass, a stone, a piece of foam, a photograph, a transparency, a piece of string, a piece of yarn, a piece of ribbon, a piece of wrapping paper, a piece of metal, a piece of fabric, a piece of plastic, a gold leaf, a fabric leaf, a semi-precious stone, a gold foil, a silver foil, a copper foil, an ink stamp, a paper stamp, a marker ink, a paint, a glass paint, an acrylic paint, a gel, a wire, a sticker, a crayon drawing, raffia, a mechanical decorative member, or combinations thereof. In some embodiments, a user attaches the decorative members 150 to the light box 100 according to his or her preference. The decorative members 150 may be attached to the display panel 110, the first single sheet 130, the second single sheet 131, the third single sheet 132, the side panels 120, the back surface of the display panel 115, the inside face of the side panels 125, or a combination thereof. The decorative members 150 are attached using a tool including but not limited to a glue, a tape, a paste, or a combination thereof.

In some embodiments, the present light box 100 does not have pieces or fragments of sheets that overlap on the display panel 110. Such feature negatively causes the display panel to have raised surfaces, uneven surfaces, and surfaces that are not smooth. Raised surfaces, uneven surfaces, and surfaces that are not smooth would limit the user's ability to apply a decorative member 150 to the light box 100. In some embodiments, the present light box does not have sheets that are permanently attached to the display panel 110 because such feature would cause the light box 100 to not be reusable. This limits a user's ability to modify and personalize the light box 100, limits a user's ability to display artistic expression, and does not encourage a user's creativity and imagination. In some embodiments, the present light box 100 does not have a decorative member 150 permanently attached to the display panel, first single sheet 130, second single sheet 131, or third single sheet 132. Such feature would negatively limit the user's ability to apply his or her own decorative member 150, and would cause the light box 100 to not be reusable. This limits a user's ability to modify and personalize the light box 100, limits a user's ability to display artistic expression, and does not encourage a user's creativity and imagination.

In some embodiments, the light box 100 may be used as a teaching device. For example, the light box 100 may be used to teach a person a subject. In some embodiments, a person includes a child, an adult, a mentally handicapped person, or a person having suffered a brain injury. In some embodiments, a subject includes reading, mathematics, spelling, vocabulary, physics, astronomy, a foreign language, music, history, letters of the alphabet, numbers, or a combination thereof. In some embodiments, a decorative member 150 comprises an educational character. In some embodiments, the educational character comprises a letter, a number, a symbol, a planet, a star, a note, a word, or a combination thereof. In some embodiments, the educational character is mechanical. In some embodiments, an educational character may be attached to the display panel 110 via a means for attaching the educational character. In some embodiments, an educational character may be attached to the outermost single layer overlaying the display panel 110 via a means for attaching the educational character. In some embodiments, a means for attaching an education character includes a magnet, a hook-and-loop fastener, a snap, an adhesive, combinations thereof, and the like. In some embodiments, the educational character is removable. In some embodiments, the educational character is removed and replaced with another educational character. In some embodiments, at least one educational character is removably attached to the outermost single layer overlaying the display panel 110, so that a different character (or different permutations of characters) may be displayed on the light box for a person (e.g., a child) to view and learn. For example, a parent can removably attach the word "Monday," "Tuesday," "Wednesday," "Thursday," "Friday," "Saturday," or "Sunday" on the light box for each day of the week; and at night the light box is illuminated to display the word on the display panel for the child to view and learn the day of the week and the spelling of the days. In some embodiments, the educational character is described or taught to the person (e.g., a child). For example, a parent can attach educational characters comprising the planets of our solar system to the light box and describe to the child various pieces of information about the planets, for example, their names, their relative locations, or their orbital patterns.

In some embodiments, the light box is placed in a location that the person can view it. For example, in some embodiments, a location may be a bedroom, a study, a den, a kitchen, or a play-room. In some embodiments, the light box is illuminated during the night or during the child's naptime. In some embodiments, the light box is illuminated during the day.

Without wishing to limit the invention to any theory or mechanism, it is believed that using the light box 100 for educational purposes is advantageous because in some embodiments, the light box 100 having one or more educational characters attached to it is illuminated at night or during the child's naptime and thus captures the attention of the child. The child is able to look at the light box and educational characters for a period of time as he or she falls asleep. As the child looks at the educational character, it reinforces the subject matter being taught to the child and enhances his or her learning of the subject.

One of ordinary skill would know how to removably attach a decorative member 150 (e.g., an educational character) to the display panel 110 or to the outermost single layer overlaying the display panel 110. For example, a decorative member 150 comprising hooks (of a hook-and-loop fastener) may attach to loops (of a hook-and-loop fastener) that are secured on the outermost single layer overlaying the display panel 110, wherein the loops are removably secured to the outer most single layer by being attached to a first magnet wherein the first magnet can removably bind to a second complementary magnet (e.g. having an opposite polarity) with the display panel 110 and outermost single sheet sandwiched between the first magnet and second magnet.

In some embodiments, the light box 100 may be used for practicing collaging techniques. For example, a person can perform a collage technique on a light box. Afterwards, the person can remove the artwork from the light box and re-decorate, thereby practicing collaging techniques by using the light box.

In some embodiments, the light box 100 may be used for entertainment purposes. In some embodiments, a user is entertained by attaching a decorative member 150 or a plurality of decorative members to the light box. As used herein, a user (e.g., an adult person or a child person) is "entertained" when the user enjoys the activity that the user is engaged in. In some embodiments, a user is entertained by removing said decorative member 150 and attaching another decorative member 150 or plurality of decorative members to the light box 100. In some embodiments, the decorative member 150 includes but is not limited to a bead, a silk flower, a dried flower, a magnet, a piece of glass, a stone, a piece of foam, a photograph, a transparency, a piece of string, a piece of yarn, a piece of ribbon, a piece of wrapping paper, a piece of metal, a piece of fabric, a piece of plastic, a gold leaf, a fabric leaf, a semi-precious stone, a gold foil, a silver foil, a copper foil, an ink stamp, a paper stamp, a marker ink, a paint, a glass paint, an acrylic paint, a gel, a wire, a sticker, a crayon drawing, raffia, a mechanical decorative member, or combinations thereof. In some embodiments, the decorative member is attached to the display panel 110, the back surface of the display panel 115, the side panel 120, the first single sheet 130, the second single sheet 131, the third single sheet 132, the outermost single sheet, or combinations thereof. In some embodiments, a decorative member may be attached to the light box 100 via a means for attaching the decorative member. In some embodiments, a means for attaching a decorative member 150 includes a magnet, a hook-and-loop fastener, a snap, an adhesive, a glue, a staple, a paste, combinations thereof, and the like. In some embodiments, the decorative member 150 is removable. In some embodiments, the light box 100 is reusable. In some embodiments, the decorative member 150 is removed and replaced with another decorative member 150.

In some embodiments, the light box 100 may be used to enhance a user's artistic development. In some embodiments, attaching a decorative member 150 or a plurality of decorative members to the light box 100 stimulates a user's creativity, and thus the user develops his or her artistic skills. In some embodiments, removing said decorative member 150 and attaching another decorative member 150 or plurality of decorative members to the light box 100 stimulates a user's creativity, and thus the user develops his or her artistic skills. In some embodiments, the decorative member 150 includes but is not limited to a bead, a silk flower, a dried flower, a magnet, a piece of glass, a stone, a piece of foam, a photograph, a transparency, a piece of string, a piece of yarn, a piece of ribbon, a piece of wrapping paper, a piece of metal, a piece of fabric, a piece of plastic, a gold leaf, a fabric leaf, a semi-precious stone, a gold foil, a silver foil, a copper foil, an ink stamp, a paper stamp, a marker ink, a paint, a glass paint, an acrylic paint, a gel, a wire, a sticker, a crayon drawing, raffia, a mechanical decorative member, or combinations thereof. In some embodiments, the decorative member 150 is attached to the display panel 110, the back surface of the display panel 115, the side panel 120, the first single sheet 130, the second single sheet 131, the third single sheet 132, the outermost single sheet, or combinations thereof. In some embodiments, a decorative member 150 may be attached to the light box 100 via a means for attaching the decorative member 150. In some embodiments, a means for attaching a decorative member

150 includes a magnet, a hook-and-loop fastener, a snap, an adhesive, a glue, a staple, a paste, combinations thereof, and the like. In some embodiments, the decorative member 150 is removable. In some embodiments, the light box is reusable. In some embodiments, the decorative member 150 is removed and replaced with another decorative member 150.

EXAMPLE

The following is an example of the construction of the light box 100 in one embodiment. To begin, the acrylic box-like structure is first built. For the display panel 110, a piece of acrylic ten (10) inches tall, ten (10) inches wide, and one-eighth (⅛) inch thick is cut. For the side panels 120, four pieces of ten (10) inches tall, two (2) inches wide, and one-eighth (⅛) inch thick acrylic mirror are cut. The acrylic for the display panel 110 and the acrylic mirror for the side panels 120 may be obtained from Professional Plastics, Phoenix, Ariz. Attach one of the side panels 120 to the display panel 110 such that the ten (10) inch edge of the side panel 120 and a ten (10) inch edge of the display panel 110 meet and align, and the two panels are perpendicular. Repeat this for the other three side panels 120, making sure all the side panels are extending from the display panel 110 in the same direction and that the mirrored side of the side panels 120 are the inside faces of the side panels 125. Using a rotary tool, bore two ventilation holes and one cord hole into a side panel 125. Next, attach the illumination source 220, which comprises a 120-volt rope light, to the inside faces of the side panels 125 using the mounting bases 230 and plastic ties 235. Hanger brackets can also be mounted onto the interior side of the side panel, e.g., the side having the mirrors. (The reflective mirrors are positioned to face inwardly towards each other and facing the rope light).

Now an acrylic box-like structure has been made and can be decorated. First, lay a first single sheet 130 comprising ethereal paper atop the display panel 110 such that it covers the display panel 110 entirely. Next, lay a second single sheet 131 comprising ethereal paper atop the first single sheet 130, making sure it covers the first single sheet 130 entirely. Then, lay a third single sheet 132 comprising rice paper on top of the second single sheet 131. Apply a gluing solution comprising about 50% tacky glue and 50% water on top of the third single sheet 132, spread the glue evenly and thoroughly so that the glue seeps through to the first single sheet 130 and second single sheet 131, and allow the gluing solution to dry.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A light box comprising (a) light-transparent display panel, wherein the display panel has a front surface and a back surface, the entire front surface of the display panel is covered by a first single sheet;

(b) a side panel attaching to and extending outwardly from the display panel; and (c) an illumination source positioned at the back surface of the display panel wherein the entire first single sheet is covered by a second single sheet, and the entire second single sheet is covered by a third single sheet;

wherein the display panel and side panel comprises a rectangular piece of acrylic;

wherein the first single sheet and second single sheet comprise a piece of ethereal paper; wherein the third single sheet comprises a piece of rice paper;

wherein the single sheets are attached to the front surface of the display panel using a gluing solution comprising about 50% tacky glue and 50% water;

wherein the side panel further comprises a reflective material;

wherein a rope light is attached to the side panel with adhesive-based mounting bases and plastic ties;

wherein the rope light lines an inner perimeter of the light box; and wherein the third single sheet is decorated with a decorative member.

* * * * *